United States Patent [19]

Hall

[11] 4,014,424

[45] Mar. 29, 1977

[54] DEVICE FOR TESTING THE FLATNESS, SIZE AND SHAPE OF COIN-TOKENS

[75] Inventor: Mitchell A. Hall, Ft. Thomas, Ky.

[73] Assignee: Monarch Tool & Manufacturing Company, Covington, Ky.

[22] Filed: June 9, 1975

[21] Appl. No.: 584,773

[52] U.S. Cl. ..... 194/102; 194/1 K

[51] Int. Cl.[2] ..... G07F 3/02

[58] Field of Search ..... 194/97 R, 97 B, 99, 194/101, 102, 103, 1 K, 1 E, 1 P; 193/DIG. 1

[56] References Cited

UNITED STATES PATENTS

| | | | |
|---|---|---|---|
| 2,009,609 | 7/1935 | Edison | 194/101 |
| 2,277,018 | 3/1942 | Patzer et al. | 194/101 |
| 2,430,320 | 11/1947 | Anderson | 194/103 |
| 2,598,010 | 5/1952 | Pillatsch | 194/102 X |
| 2,630,200 | 3/1953 | Hehn | 194/101 |
| 2,763,356 | 9/1956 | Tratsch | 194/101 |
| 3,488,444 | 1/1970 | Porsner | 194/102 X |

*Primary Examiner*—Drayton E. Hoffman
*Assistant Examiner*—Francis J. Bartuska
*Attorney, Agent, or Firm*—J. Warren Kinney, Jr.

[57] ABSTRACT

A coin testing device includes one or more coin-receptive slots of specific depth, height and width for testing the flatness, thickness and diameter of like, "on-edge" coin-tokens which pass therethrough, and a rearwardly declining deck projecting from the slots for receiving and advancing acceptable coin-tokens, wherein a guide member is disposed upwardly from and substantially parallel to the deck for engaging the peripheral edge adjacent face of acceptable coin-tokens for testing the peripheral configuration thereof, wherein ultimately accepted coin-tokens are advanced across the deck and are guided by the guide member into coin-receptive discharge apertures which are disposed at substantially right angles to the slots.

19 Claims, 11 Drawing Figures

FIG-1
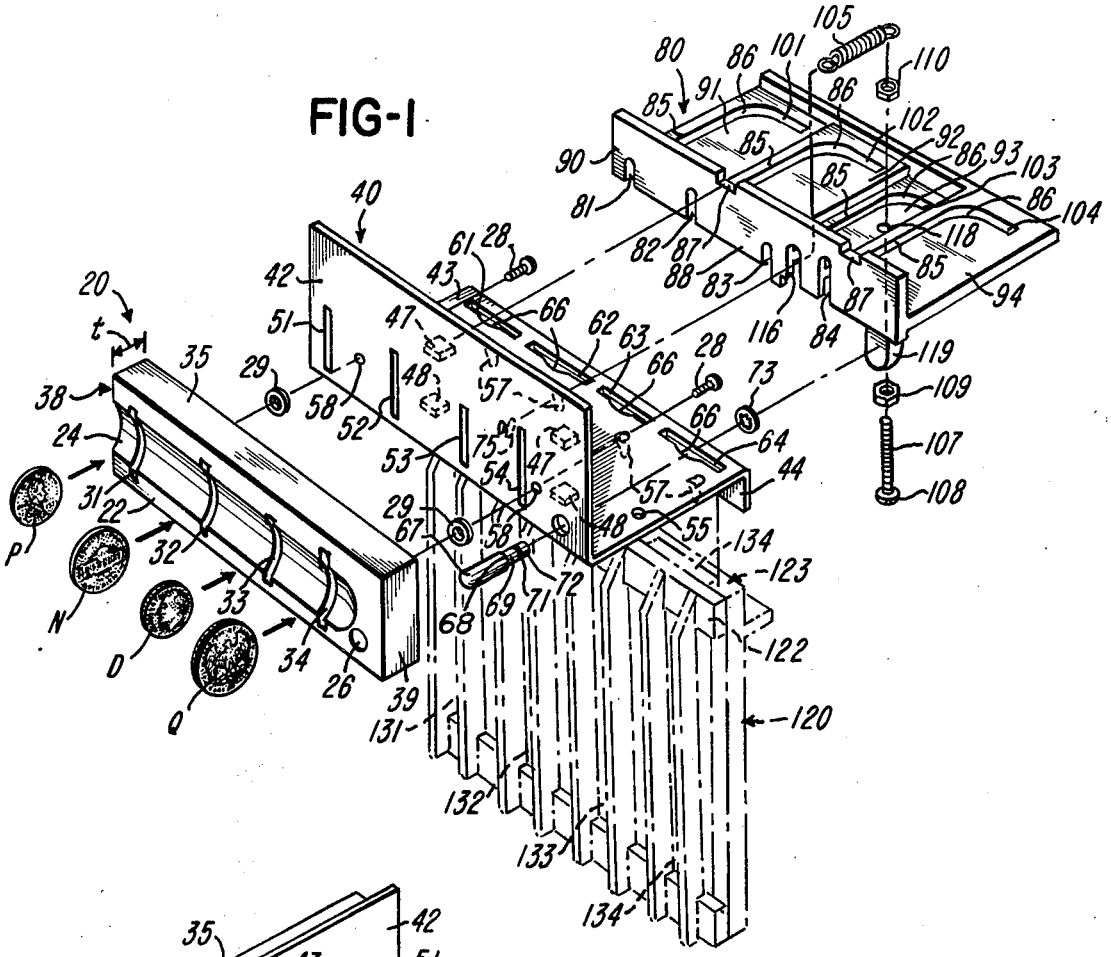
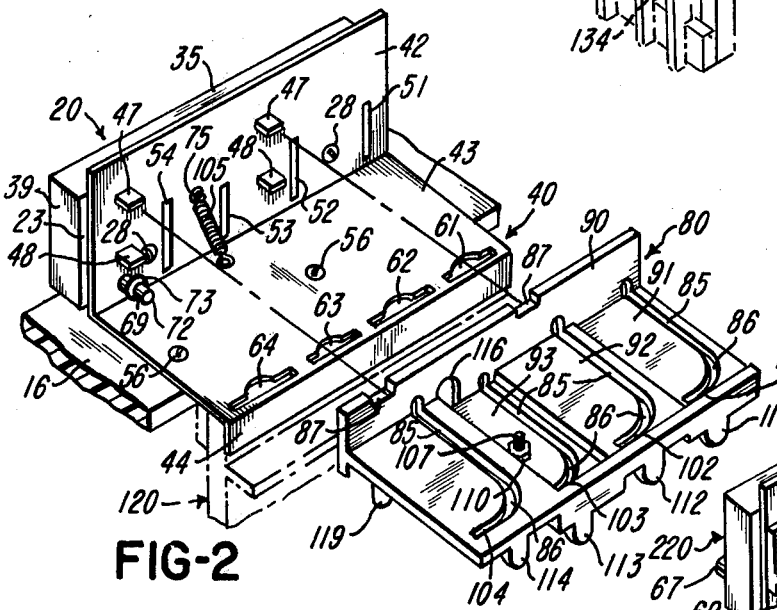
FIG-2
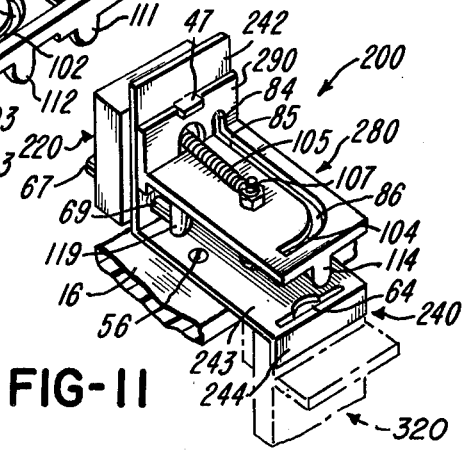
FIG-11

DEVICE FOR TESTING THE FLATNESS, SIZE AND SHAPE OF COIN-TOKENS

BACKGROUND OF THE INVENTION

1. Field of the Invention

The present invention is directed to a coin testing device for sorting acceptable and nonacceptable coins of like denomination. The coin testing device receives "edge-inserted" coin-tokens, tests each coin-token for flatness, size and peripheral configuration, turns acceptable coin-tokens approximately 90° and deposits the accepted, turned coin-tokens in coin-receptive discharge apertures.

2. Description of the Prior Art

Coin testing devices which include movable calipering means are highly susceptible to contamination by dirt, moisture and other adverse conditions present in the environment of many coin-operated industries such as, by way of example, coin operated laundries and the like. When said devices are exposed to the lint, moisture and laundry powders present in a laundry environment, the moving parts of the caliper means may become clogged and inoperative.

SUMMARY OF THE INVENTION

The present invention is directed to a coin testing device which is not readily susceptible to dirt, moisture and the like. The coin pathways are open and ventilated and are easily and economically kept free and clear. The calipering means of the device is free of moving parts and is not readily clogged or jammed when subjected to foreign elements present in the environment.

The device is versatile and dependable. It is of simple construction and is easy to assemble, operate and maintain. The device may be exposed to moisture, heat, lint, detergent powder, wet and dirty coins, vibration, and other undesirable conditions without adversely effecting the operation thereof.

In those instances when the coin testing device is associated with a coin-receptive member, the device is designed to permit natural drainage of moisture with a minimum of the moisture being deposited in the associated member. The subject device provides a shield for and virtually precludes malicious tampering with the member as well.

The coin-testing device comprises, in general, a face plate having one or more coin-receptive apertures, a deck plate and a coin-receptive guide which collectively receive and caliper "edge-inserted" coin-tokens and deposit accepted coin-tokens in one or more coin-receptive discharge apertures which are disposed at substantially right angles to the apertures in the face plate. The face plate is a solid member, wherein the coin-receptive apertures thereof are of predetermined depth to preclude the insertion of bent coints therethrough. The deck plate is disposed in communication with the face plate and includes one or more complementary, accurately sized calipering apertures for testing the thickness and diameter of the flat coin-tokens which have passed through the apertures of the face plate. The coin-tokens are then introduced onto and gravitate toward the rear of a flat, rearwardly declined deck.

A guide member is pivotally secured to the deck plate and is normally spaced upwardly from and substantially parallel to the deck. The guide member includes a plurality of channels for engaging the peripheral edge adjacent face of acceptable coin-tokens for directing the coin-tokens toward and depositing the coin-tokens in discharge apertures in the deck disposed at substantially right angles to the apertures in the face plate.

The member will not engage undersize coin-tokens which roll, unguided, across the deck and bypass the discharge apertures. Coin-tokens of an irregular configuration are engaged by the channels of the guide member but are wedged between the guide member and the deck when turned toward the discharge aperture. The outer end portion of the guide member is adapted to be pivoted upwardly from the deck, whereby the irregular coin-token is released from the channel, rolls unguided across the deck and bypasses the discharge apertures.

It is, therefore, a primary object of the present invention to provide a durable and versatile coin testing device which is easy to construct, maintain and use for receiving, calipering and directing coin-tokens into coin-receptive discharge apertures which are disposed at substantially right angles to the coin-tokens as received, wherein the device is adapted for use in environments heretofore considered undesirable.

Other objects and features of the present invention will be readily apparent from the drawings and from the detailed description which follows.

BRIEF DESCRIPTION OF THE DRAWINGS

FIG. 1 is an exploded perspective view illustrating the various components of a coin-testing device which embodies the teachings of the present invention.

FIG. 2 is a rear perspective view of the components of FIG. 1 with the face plate and deck plate in assembled relationship.

FIG. 11 is a perspective view of a coin-testing device for a coin-token of a single, predetermined value.

DESCRIPTION OF THE PREFERRED EMBODIMENTS

Figures 3, 4, 5, 6, 7, 8, 9, 10:
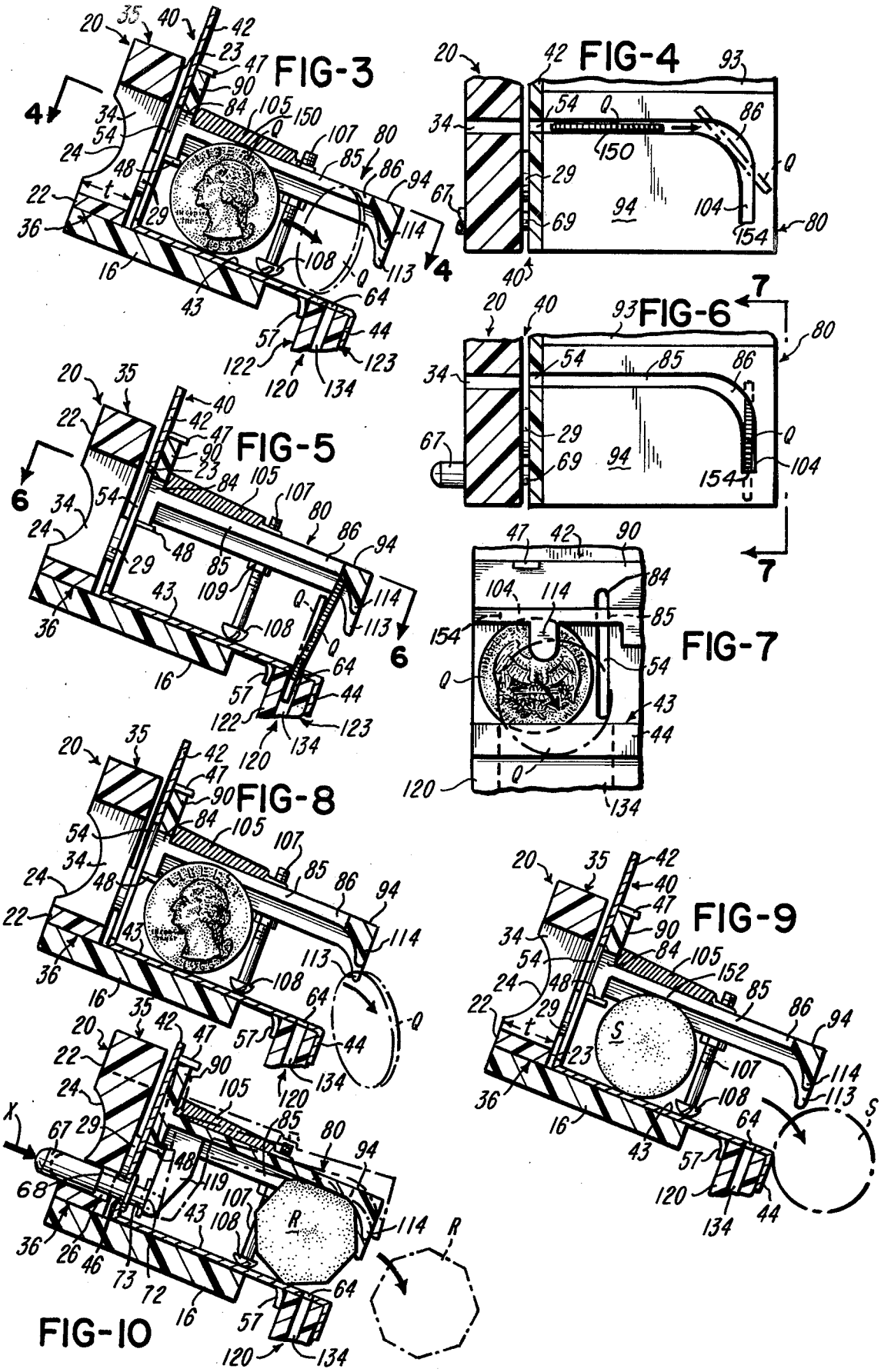
FIG. 3 is a side view shown in section and diagrammatically illustrates the progress of an acceptable coin-token through the coin testing device.
FIG. 4 is a top view partly in section taken at line 4—4 of FIG. 3.
FIG. 5 is a view similar to FIG. 3 and diagrammatically illustrates an acceptable coin-token being introduced into the discharge aperture.
FIG. 6 is a top view partly in section taken at line 6—6 of FIG. 5.
FIG. 7 is an end view taken at line 7—7 of FIG. 6.
FIG. 8 is a view similar to FIG. 3 and diagrammatically illustrates what occurs when an acceptable coin-token is introduced too rapidly into the apertures of the face plate.
FIG. 9 is view similar to FIG. 3 and diagrammatically illustrates the progress of an undersize slug-token through the coin testing device.
FIG. 10 is a view similar to FIG. 3 and diagrammatically illustrates the progress of an irregular slug-token through the coin testing device.

A coin testing device which embodies the features of the present invention is illustrated in FIG. 1 and comprises, in general, face plate 20, deck plate 40 and track or guide member 80, which include a plurality of elongate, coin-token receptive apertures or slots 31–34, 51–54, and 81–84, respectively. Complementary sets of slots 31–51–81, 32–52–82, 33–53–83, and 34–54–84 are adapted for receiving coin-tokens P, N, D and Q, or the like, respectively. The device is adapted to sort coin-tokens as to their flatness, thickness, diameter and peripheral configuration, wherein only the accepted tokens are advanced toward and ultimately deposited in coin-receptive discharge apertures 61–64 which are disposed at substantially right angles to slots 31–34, 51–54 and 81–84.

The device is adapted for use as a separate, independent unit for sorting coin-tokens or may be used in combination with a coin-receptive member such as, by way of example, the vertical coin chute 120 shown in phantom in the drawings.

The vertical coin chute, per se, does not form a part of the present invention, and a detailed description thereof is not included hereon. Broadly speaking, the vertical coin chute 120 comprises front and back walls 122 and 123 which define a plurality of inclined, open-ended coin-slides 131, 132, 133 and 134, wherein slides 131–134 are disposed in communication with discharge apertures 61–64 for receiving coin-tokens P, N, D and Q, respectively.

THE FACE PLATE

Face plate 20 comprises an elongate, rectangular solid member having front and back faces 22, 23; upper and lower edge-faces 35, 36; and opposite end faces 38, 39. The face plate includes a plurality of parallel, transversely spaced coin-token receptive slots 31, 32, 33 and 34 which are adapted for receiving coin-tokens, P, N, D and Q, respectively. Front face 22 includes an elongate, transversly extending, concave channel 24 which intersects each of the slots 31–34. Channel 24 provides clearance for readily permitting manual, "on-edge" insertion of the coin-tokens into slots 31–34.

The face plate is a solid member of specific depth or thickness *t* which is greater than the radius but less than the diameter of the smallest coin-token which is to be deposited in each of the slots 31–34. The depth of said face plate precludes the insertion of bent coin-tokens or the like through slots 31–34.

Clearance hole 26 through plate 20 is adapted for loosely accomodating actuator stem 67 of the deck plate 40 when the upper coin track is fully assembled as illustrated in FIGS. 3–10.

THE DECK PLATE

Deck plate 40 comprises a flat rearwardly declining deck 43 having forward and rearward ends which terminate in an upstanding front deck wall 42 and a depending rear deck wall 44, respectively.

Front deck wall 42 defines a mounting surface for face plate 20 and includes a plurality of elongate, transversely spaced calipering slots 51, 52, 53 and 54 which are complementary with slots 31–34, respectively. Each slot is accurately sized to effectively preclude the insertion of oversize coin-tokens into the coin-token receptive slots of the device. The front deck wall includes a pair of clearance holes 58,58 which accommodate mounting screws 28,28 or the like for securely though releasably mounting face plate 20 to deck plate 40. Spacer-washers 29,29 or the like, are disposed intermediate the front deck wall 42 and the rear face 23 of the face plate for providing an open space between the face plate and the deck plate, whereby any debris which passes through slots 31–34 falls free of the device and keeps the accurately sized slots 51–54 open and clear.

Deck 43 projects rearwardly from front deck wall 42 and provides a smooth, planar surface upon which acceptable coin-tokens are advanced toward their respective discharge apertures 61–64. The deck 43 declines rearwardly from front wall 42, whereby the coin-tokens which are edge-inserted in slots 31–34, 51–54 gravitate on edge toward the rearward end of the deck.

A plurality of elongate, transversely extending coin-receptive discharge apertures 61, 62, 63 and 64 are disposed at substantially right angles to slots 31–34, 51–54 in deck 43 adjacent rear wall 44. Apertures 61–64 are complementary with slots 31–34 and 51–54, respectively, and are sized to receive specific like coin-tokens P, N, D and Q. Each aperture 61–64 is enlarged at 66 for permitting each acceptable coin-token to rock or sway relative to deck 43 as it is advanced into and aligned with slots 61–64, whereby proper seating of the cointoken in the slot is ensured (FIG. 5). The coin-tokens which pass through slots 51–54 are advanced toward and deposited in apertures 61–64 after which the coins drop through deck 43 and, where provided, into the coin-receptive slides 131–134 of coin chute 120, or the like.

As will be readily apparent from the drawings, the wide, flat surface of deck 43 precludes tampering with an associated vertical coin chute 120 by means of a stiff wire-like probe or the like inserted in slots 31–34, 51–54.

A plurality of transversely spaced tabs 57 which project downwardly from deck 43 forwardly of rear wall 44 are provided to define an elongate, transversely extending channel for receiving the upper end of a vertical coin chute 120 and for aligning the upper, open ends of coin-slides 131–134 thereof with apertures 61–64, respectively. The front and rear walls 122, 123 of the vertical coin-chute form a snut, slip-fit relationship with tabs 57 and wall 44, whereby the vertical chute 120 may be securely though releasably mounted in and carried by the deck.

Mounting hole 46 extends through front wall 42 of the deck plate and is in axial alignment with clearance hole 26 of face plate 20. An elongate actuator stem 67 terminates in reduced end-portion 69 which is slidably received by mounting hole 46. Resilient retainer ring 73 is securely locked in the circumferential, ring-receptive channel 71 adjacent forward tip 72 of the stem for securely though releasably maintaining stem 67 in mounting hole 46. The stem is movable between positions of full advancement and retraction as shown in FIG. 10. Shoulder 68 provides a positive stop for limiting the advancement of the stem into deck plate 40, whereas the ring 73 provides a positive stop for limiting the retraction of the stem out of the deck plate.

Deck plate 40 is secured to and carried by support structure such as plate 16 or the like via a plurality of mounting screws 56, 56 which are loosely accommodated by clearance holes 55, 55 in deck 43 (FIG. 2). Generally, mounting plate 16 is rearwardly declined at an angle of approximately 22° whereby coin-tokens inserted in slots 31–34, 51–54 readily gravitate and advance across deck 43 in the described manner.

THE GUIDE MEMBER

Guide member 80 comprises substantially vertical, upstanding front guide wall 90, a plurality of integral, stepped, substantially horizontal guide plates 91–94 which project rearwardly from the front guide wall, and a plurality of substantially vertical abutments 111–114 which depend from plates 91–94, respectively. The abutments are in open communication with the coin-receptive channels of corresponding plates 91–94 and preclude premature release of coin-tokens therefrom.

The front guide wall 90 includes a flat, substantially horizontal lower edge 88 and a pair of notches 87,87. The notches and edge are adapted for receiving tabs 47,47 and 48,48, which are secured to, carried by and project rearwardly from front deck wall 42, whereby the guide member is mounted for pivotal movement relative to deck plate 40. Clearance hole 118 in guide plate 93 accommodates an elongate post such as threaded, adjustable screw 107 or the like which projects downwardly from the guide plate and provides a positive stop at head 108 for limiting pivotal movement of the track member relative to deck 43. A pair of lock-nuts 109, 110 or the like are carried by threaded screw 107 adjacent the upper and lower surfaces, respectively, of guide plate 93 for securely though releasably locking the threaded screw relative to the guide member.

Opposite ends of tension spring 105 are secured to the guide member at screw 107 and to the front deck wall at the integral, spring-receptive hook 75 (FIGS. 1 and 2). Clearance channel 116 in the guide member provides an unobstructed passageway for the spring. The spring normally urges head 108 of the elongate screw into abutting engagement with deck 43 and normally urges front guide wall 90 into abutting engagement with the front deck wall 42 (FIG. 3).

Abutment 119 depends from guide member 80 and engages tip 72 of stem 67, whereby the stem is normally urged toward the fully retracted position via spring 105. When stem 67 is advanced in the direction of arrow X, tip 72 engages and advances abutment 119 and imparts pivotal movement of the guide member 80 about tabs 47,47, as shown in phantom in FIG. 10. Spring 105 returns the guide member 80 and stem 67 to the normal, retracted position when the stem is released.

Front guide wall 90 includes a plurality of elongate, transversely spaced slots 81, 82, 83 and 84 which are in axial alignment with guide plates 91–94, respectively. Slots 81–84 are complementary with, are in open communication with and are adapted for receiving the coin-tokens P, N, D and Q which are inserted in slots 31–34, 51–54, respectively. The slots 81–84 receive and introduce the coin-tokens into the coin-receptive channels of plates 91–94, respectively.

Each coin-receptive channel comprises a straight, substantially rearwardly extending portion 85 having a forward end which is in open communication with the corresponding slot 81–84 and a rearward end which terminates in a curved portion 86. Curved portions 86 are in open communication with straight end-portions 101, 102, 103 and 104 which are disposed at substantially right angles to portions 85. The end-portions 101–104 are in alignment with and spaced upwardly from apertures 61–64, respectively.

Guide plates 91–94 are substantially parallel to and accurately spaced upwardly from deck 43 such that only the peripheral edge adjacent portion of an accepted coin-token is in communication with channels 85, 86, 101–104 as the coin-token advances across deck 43 (FIG. 3).

OPERATIONAL MODE

The operation of the coin testing device is diagrammatically illustrated in FIGS. 3–7, wherein an acceptable coin-token Q is edge inserted into coin-receptive slot 34 of face plate 20, is advanced through slot 54 and engages deck 43 of deck plate 40. The coin-token Q is tested for straightness by the depth *t* of face plate 20 and is tested for diameter and thickness by the accurately sized slot 43 of the deck plate. The coin-token enters slot 84 in front guide wall 90 and is introduced into the elongate channel 85 of plate 94. The peripheral edge-adjacent portion of the advancing coin-token engages the side walls of channel 85 as at 150 (FIGS. 3 and 4), and the coin-token gravitates toward curved channel 86 of plate 94.

As the coin-token advances through curved channel 86 (FIG. 4), it is aligned with and deposited in end-channel 104 (FIG. 6). In practice, it has proven beneficial to enlarge the width of the curved channel 86 for facilitating advancement of the coin-token about the curved path provided thereby. The coin-token decelerates as it negotiates the curved channel 86, strikes closed end 154 of the end-channel 104 and falls into the complementary discharge aperture 64 of deck 43 (FIGS. 5 and 7). Abutment 114 ensures that the coin-token does not prematurely fall free of the device as the coin-token enters aperture 64. After the coin-token is properly seated in aperture 64, the coin-token falls through deck 43 and, where provided, into the complementary coin-slide 134 of vertical coin chute 120 or the like.

As described, thickness *t* of face plate 20 precludes the introduction of bent coin-tokens into the device, whereas the accurately sized slots 51–54 of front deck wall 42 precludes the passage of oversize coin-tokens. Further, coin-tokens which are improperly introduced into the slots 31—34 of face plate 20 with an excessive forward thrust in attempt to bypass certain of the calipering mechanisms will bypass apertures 61–64 and will be removed from the device as illustrated in FIG. 8. Undersize slug-tokens such as, by way of example, token S will be detected by and removed from the device as shown in FIG. 9. Slug-tokens of irregular peripheral configuration such as, by way of example, the octagonal token R will be detected by and removed from the device as shown in FIG. 10.

With particular reference to FIG. 8, coin-token Q which is too rapidly inserted in slot 34, enters curved channel 86 at too great a speed whereby the peripheral edge adjacent portion of the coin-token is disengaged from the guide member. Thereafter the coin-token rolls, unguided, across deck 43, bypasses aperture 64 and falls through the open space between plate 94 and deck 43.

As shown in FIG. 9, the undersize slug-token S is similarly removed from the device. As token S passes through slot 84 and enters channel 85, the peripheral edge adjacent portion of token S does not engage the side walls of the channel and the token is unguided as it rolls rearwardly across deck 43. The token bypasses aperture 64 and falls through the open space between plate 94 and deck 43.

The device precludes the introduction of irregular slug-token R into the discharge apertures 61–64 as shown in FIG. 10. As the token enters curved channel 86 it becomes lodged or wedged between deck 43 and plate 94, whereby further advancement of the token is precluded. The token is removed from the device by advancing actuator stem 67 in the direction of arrow X, thereby pivoting guide member 80 upward from deck 43, after which token R falls through the enlarged open space between plate 94 and deck 43. Spring 105 returns plate 94 to its normal position when stem 67 is released.

MODIFIED EMBODIMENT

A single channel coin testing device 200 is illustrated in FIG. 11 and where desired may be used with a vertical coin chute 320 having a single coin-receptive slide. The device 200 comprises a modified face plate 220, modified deck plate 240 and modified guide member 280, each of which have a single coin-receptive slot which is in axial alignment with channel 85 for advancing a coin-token to and depositing the coin-token in the single discharge aperture 64 of deck 243.

The deck plate 240 comprises a front deck wall 242 and a rear deck wall 244, wherein face plate 220 is secured to and carried by front deck wall 242 and wherein vertical chute 320 depends from and is secured to the deck plate 240. Front guide wall 290 is mounted for pivotal movement relative to front deck wall 242 and is controlled by spring 105 and actuator stem 67.

It should, of course, be understood that the device 200 is assembled and operated in the same manner as the device of FIGS. 1–10. Therefore, like reference numerals have been applied to the remaining, similar elements for ease of understanding.

The coin testing device may, of course, comprise any desired number of parallel guide plates without departing from the scope and spirit of the present invention, viz, a coin-testing device having one or more coin-receptive apertures, a deck plate and a pivotal guide member for collectively sorting coin-tokens as to flatness, size and peripheral configuration, wherein only the accepted tokens are advanced toward and ultimately deposited in coin-discharge apertures which are disposed at substantially right angles to the coin-receptive apertures.

What is claimed is:

1. A device for testing coin-tokens for flatness, diameter, thickness and roundness, and for advancing, turning, and then depositing acceptable coin-tokens into a discharge aperture comprising:

a. an upstanding first member having a substantially vertical elongate slot therethrough, dimensioned to accept coin-tokens which do not exceed a predetermined standard of flatness, diameter and thickness;

b. a second member projecting at substantial right angles from said first member and having a support surface over which a coin-token introduced through said slot is gravitationally advanced on-edge and having a substantially horizontal coin-token receptive discharge aperture therethrough at a location remote from said first member and lying in a plane angularly disposed relative to the slot;

c. a third member disposed above and in spaced, substantially parallel relationship with said second member, wherein said third member includes means engageable by the upper peripheral-adjacent edge of an acceptable on-edge coin-token supported on the second member for guiding it toward and then turning it relative to and in vertical alignment with said horizontal aperture; and d. means mounting said third member for pivotal movement relative to said second member.

2. A device as called for in claim 1, wherein the spacing of the third member relative to the second member is such that a coin-token having prerequisite flatness, thickness, and roundness, but less than prerequisite diameter, will not engage said third member.

3. A device as called for in claim 1, which includes an adjustable positive stop secured to and projecting from one of said second and third members for limiting the relative movement therebetween.

4. A device as called for in claim 1, which includes an elongate actuator slidably carried by and projecting outwardly from said upstanding first member and operable to engage and pivot said third member outwardly and upwardly from said second member.

5. A device as called for in claim 1, which includes means for adjusting the relative position of the second and third members.

6. A device as called for in claim 1, wherein said support surface is downwardly inclined from said first member.

7. A device as called for in claim 1, wherein said third member includes a lower or undersurface in spaced parallelism with the support surface of the said second member, and wherein said lower or undersurface includes a substantially L-shaped channel or groove dimensioned to receive an upper-peripheral-adjacent-edge of an on edge coin-token supported on the second member.

8. A device as called for in claim 7, wherein the said channel or groove comprises a first portion extending from and in open communication with the upper end of the vertical slot of said first member, and a second or terminal portion at substantial right angles with said first portion disposed above and in vertical alignment with the horizontal aperture of said second member.

9. A device as called for in claim 8, wherein the first and second portions of said channel or groove are joined by an intermediate curved portion, the overall width of which exceeds the width of said first and second portions.

10. A device as called for in claim 9, wherein the relationship between the first, second and curved portions of said channel or groove is such as to suddenly decelerate and then stop the rate of forward movement of an acceptable cointoken when it reaches and is located in said second portion, whereby an acceptable coin-token is presented to and in on edge vertical alignment with the discharge aperture of the second member.

11. A device as called for in claim 1, wherein the spacing between said second and third members is such that spurious coin-tokens of less than prerequisite roundness are restrained from being gravitationally advanced on edge over the support surface of the second member.

12. A device as called for in claim 11, which includes means operable to move said third member relative to said second member to dislodge and eject a spurious coin-token whose movement over the support surface of said second member has been restrained.

13. A device as called for in claim 8, wherein an abutment depends from the outer end of said third member adjacent, but beyond the second or terminal portion of said channel or groove for precluding the accidental or unintentional ejection of acceptable cointokens without entering the discharge aperture of the second member.

14. A device as called for in claim 1, wherein the horizontal coin-token discharge aperture through the second member comprises an elongate slot dimensioned to loosely receive acceptable coin-tokens, and wherein the central portion of that side of said slot adjacent the first member is enlarged to facilitate the on edge introduction of acceptable coin-tokens as presented to said slot from the second or terminal portion of the channel or groove of said third member.

15. A device as called for in claim 1, wherein said upstanding first member comprises: an upstanding inner, or caliper panel which is integral with and projects upwardly from the support surface of the second member, and which includes an elongate, vertical slot therethrough dimensioned to accept coin-tokens which do not exceed predetermined standards of flatness, diameter and thickness, and an outer face plate secured relative to and disposed in advance of and in spaced parallelism with said inner or caliper panel, and which includes an elongate vertical slot of a depth which is greater than the radius, but less than the diameter of an acceptable coin-token.

16. A device as called for in claim 15, wherein said outer face plate includes forward or outer surface having a concave area therein which spans a portion of the slot for facilitating the introduction of coin-tokens into the slot of said face plate.

17. A device as called for in claim 1, wherein the second member includes a depending rear wall which is parallel to and spaced rearwardly of the said horizontal aperture of the second member; and a plurality of depending tabs parallel to said rear wall and spaced forwardly of said horizontal aperture, whereby said depending rear wall and tabs define means for facilitating the attachment of means to receive acceptable cointokens which are discharged through the horizontal aperture of the second member.

18. A device as called for in claim 6, wherein the said support surface is inclined at an angle of from 15°–30° relative to horizontal.

19. A device as called for in claim 1, wherein the first member includes a plurality of vertical elongate slots each of which are dimensioned to accept like coin-tokens of a particular denomination; the second member includes a plurality of coin-token discharges apertures, one for each particular denomination; and the third member includes means for guiding like coin-tokens of a particular denomination between their respective elongate slots in the first member to their respective discharge apertures in the second member.

* * * * *